United States Patent [19]

Oldfelt et al.

[11] Patent Number: 5,007,117

[45] Date of Patent: Apr. 16, 1991

[54] VACUUM TOILET SYSTEM WITH SIMULTANEOUS RINSE AND DISCHARGE

[75] Inventors: Sven Oldfelt, Vaxholm, Sweden; Gary L. Stahl, Winnebago, Ill.

[73] Assignee: Oy Wärtsilä Ab, Helsinki, Finland

[21] Appl. No.: 288,620

[22] Filed: Dec. 21, 1988

[51] Int. Cl.[5] ..... E03D 11/00

[52] U.S. Cl. ..... 4/432; 4/435

[58] Field of Search ..... 4/216, 300, 316, 317, 4/321, 323, 406, 431, 434, 435, 432

[56] References Cited

U.S. PATENT DOCUMENTS

| | | | |
|---|---|---|---|
| 3,239,849 | 8/1966 | Liljendahl | 4/300 X |
| 3,599,248 | 8/1971 | Fulton et al. | 4/438 |
| 3,686,693 | 8/1972 | Liljendahl | 4/300 |
| 3,811,135 | 5/1974 | Drouhard, Jr. et al. | 4/435 |
| 3,922,730 | 12/1975 | Kemper | 4/316 |
| 4,232,409 | 11/1980 | Van Pham | 4/362 |
| 4,275,470 | 6/1981 | Badger et al. | 4/316 |
| 4,357,719 | 11/1982 | Badger et al. | 4/316 |
| 4,713,847 | 12/1987 | Oldfelt et al. | 4/316 |
| 4,819,279 | 4/1989 | Sigler et al. | 4/300 |

FOREIGN PATENT DOCUMENTS

| | | | |
|---|---|---|---|
| 1023903 | 1/1978 | Canada | 4/434 |
| 1094253 | 1/1981 | Canada | 4/431 |
| 2194260 | 3/1988 | United Kingdom | 4/300 |

OTHER PUBLICATIONS

Mansfield, "Vacu-Flush", brochure (entire document) (date unknown).

Mansfield, "Vacu-Flush" Owners Manual (entire document) (date unknown).

*Primary Examiner*—Henry J. Recla

*Assistant Examiner*—Robert M. Fetsuga

*Attorney, Agent, or Firm*—Dellett, Smith-Hill and Bedell

[57] ABSTRACT

A vacuum toilet system comprises a waste-receiving bowl defining an interior space for receiving waste material. A sewer pipe defines an interior space that can be placed at a pressure that is lower than that in the interior space of the waste-receiving bowl, and a discharge valve is connected between the outlet of the waste-receiving bowl and the sewer pipe for controlling passage of material between the waste-receiving bowl and the sewer pipe. A rinse liquid valve controls supply of rinse liquid to the waste-receiving bowl. A controller is responsive to a user stimulus to open and close the discharge valve in accordance with a predetermined cycle, and to open the rinse liquid valve during at least the interval during which the discharge valve is being opened.

18 Claims, 2 Drawing Sheets

A FLUSH SWITCH
ON
OFF
B VACUUM BLOWER
ON
OFF
C RINSE WATER VALVE
OPEN
CLOSED
D DISCHARGE MOTOR
ON
OFF
E DISCHARGE VALVE
OPEN
CLOSED
F CYCLE TIMER
RUNNING
STOPPED
RINSE WATER VALVE
OPEN
CLOSED
DISCHARGE MOTOR
ON
OFF
DISCHARGE VALVE
OPEN
CLOSED

VACUUM TOILET SYSTEM WITH SIMULTANEOUS RINSE AND DISCHARGE

BACKGROUND OF THE INVENTION

This invention relates to a vacuum toilet system with simultaneous rinse and discharge.

It has for many years been conventional to use recirculating toilet systems in aircraft because a relatively large amount of liquid is required to transport the waste material in a gravity toilet system, and by recirculating the liquid the total quantity of liquid required to operate the system is reduced. Recirculating toilet systems are subject to the disadvantage that the recirculating liquids that they employ are corrosive, and therefore leakage from a recirculating toilet system may enable the corrosive liquid to contact structural members of the aircraft, resulting in the structural integrity of the aircraft being impaired.

Vacuum toilet systems have been known for many years. The modern vacuum toilet system comprises a waste-receiving bowl, a sewer pipe that can be placed under a pressure that is substantially lower than that in the interior of the waste-receiving bowl, and a discharge valve for controlling passage of material from the waste-receiving bowl into the sewer pipe. When the discharge valve is opened, material in the waste-receiving bowl is transported into the sewer pipe by virtue of the pressure difference between the interior of the waste-receiving bowl and the interior of the sewer pipe. The system also comprises a source of rinse liquid and a rinse liquid valve for controlling introduction of rinse liquid into the waste-receiving bowl.

Vacuum toilet systems do not lend themselves to recirculation, because of the large pressure difference between the downstream side of the discharge valve and the upstream side of the rinse liquid valve. However, because vacuum toilet systems rely on vacuum for removal of the waste material from the bowl, the amount of rinse liquid that is needed in the vacuum toilet system is much smaller than the amount of rinse liquid required in a gravity toilet system. Consequently, non-recirculating vacuum toilet systems employing water as rinse liquid are attractive for use in aircraft.

Use of vacuum toilet systems is not confined to aircraft, and vacuum toilet systems are used aboard other transport vehicles, such as ships, buses and trains. Vacuum toilet systems have also found use in stationary installations.

A problem with conventional vacuum toilet systems, particularly those aboard passenger vehicles, is that of noise generated when the discharge valve is opened and air rushes at high speed into the sewer pipe.

U.S. Pat. No. 4,713,847 issued Dec. 22, 1987, the disclosure of which is hereby incorporated by reference herein, describes a vacuum toilet system designed for use aboard aircraft. In a practical implementation of that system, the rinse water valve is opened in response to actuation of a flush button, and the rinse water valve remains open for approximately 0.7 s and then closes. About 0.3 s later, the discharge valve begins to open, allowing the contents of the toilet bowl to be removed. The discharge valve takes about 0.5 s to open, remains open for about 3 s and then takes about 0.5 s to close. This sequence of operations was adopted in order to be sure there was time for the rinse water to clean waste material from the side of the bowl before the discharge valve is opened, and to provide a pool of water in the bottom of the bowl in order to reduce the level of noise when the discharge valve opened. In addition, by opening the valves sequentially, the peak current required by the installation is minimized.

In a known vacuum toilet system designed for use aboard a ship, the rinse liquid valve opens, before the discharge valve opens, remains open while the discharge valve is open, and closes after the discharge valve has closed. In this system, minimizing the quantity of rinse liquid is not a major objective.

SUMMARY OF THE INVENTION

A preferred embodiment of the invention in a first aspect is a vacuum toilet system comprising a waste-receiving bowl defining an interior space for receiving waste material and having an outlet, a sewer pipe defining an interior space that can be placed at a pressure that is lower than that in the interior space of the waste-receiving bowl, a discharge valve connected between the outlet of the waste-receiving bowl and the sewer pipe for controlling passage of material between the waste-receiving bowl and the sewer pipe, and rinse means for controlling supply of rinse liquid to the waste-receiving bowl. Control means are connected to the discharge valve and to the rinse means and are responsive to a user stimulus to open and close the discharge valve in accordance with a predetermined cycle comprising an opening phase, an open phase and a closing phase, and to control the rinse means in such manner that rinse liquid is supplied during at least one of the opening phase and closing phase of the operating cycle of the discharge valve but substantially no rinse liquid is supplied while the discharge valve is closed or during the open phase of the operating cycle of the discharge valve.

A preferred embodiment of the invention in a second aspect is a method of operating a vacuum sewage system that comprises a waste-receiving bowl defining an interior space for receiving waste material and having an outlet, a sewer pipe defining an interior space that can be placed at a pressure that is lower than that in the interior space of the waste-receiving bowl, a discharge valve connected between the outlet of the waste-receiving bowl and the sewer pipe for controlling passage of material between the waste-receiving bowl and the sewer pipe, and rinse means for controlling supply of rinse liquid to the waste-receiving bowl. The method comprises operating the discharge valve in accordance with a predetermined operating cycle in response to a user stimulus, the operating cycle comprising an opening phase, an open phase and a closing phase, and operating the rinse means in such a manner that rinse liquid is supplied during at least one of the opening phase and the closing phase of the operating cycle of the discharge valve but substantially no rinse liquid is supplied while the discharge valve is closed or during the open phase of the operating cycle of the discharge valve.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

The invention will now be described with reference to an aircraft, but it should be understood the application of the invention is not limited to aircraft. The invention can be used as well in other vehicles, in particular in ships, buses and trains and can also be used in stationary installations.

Figure 1:
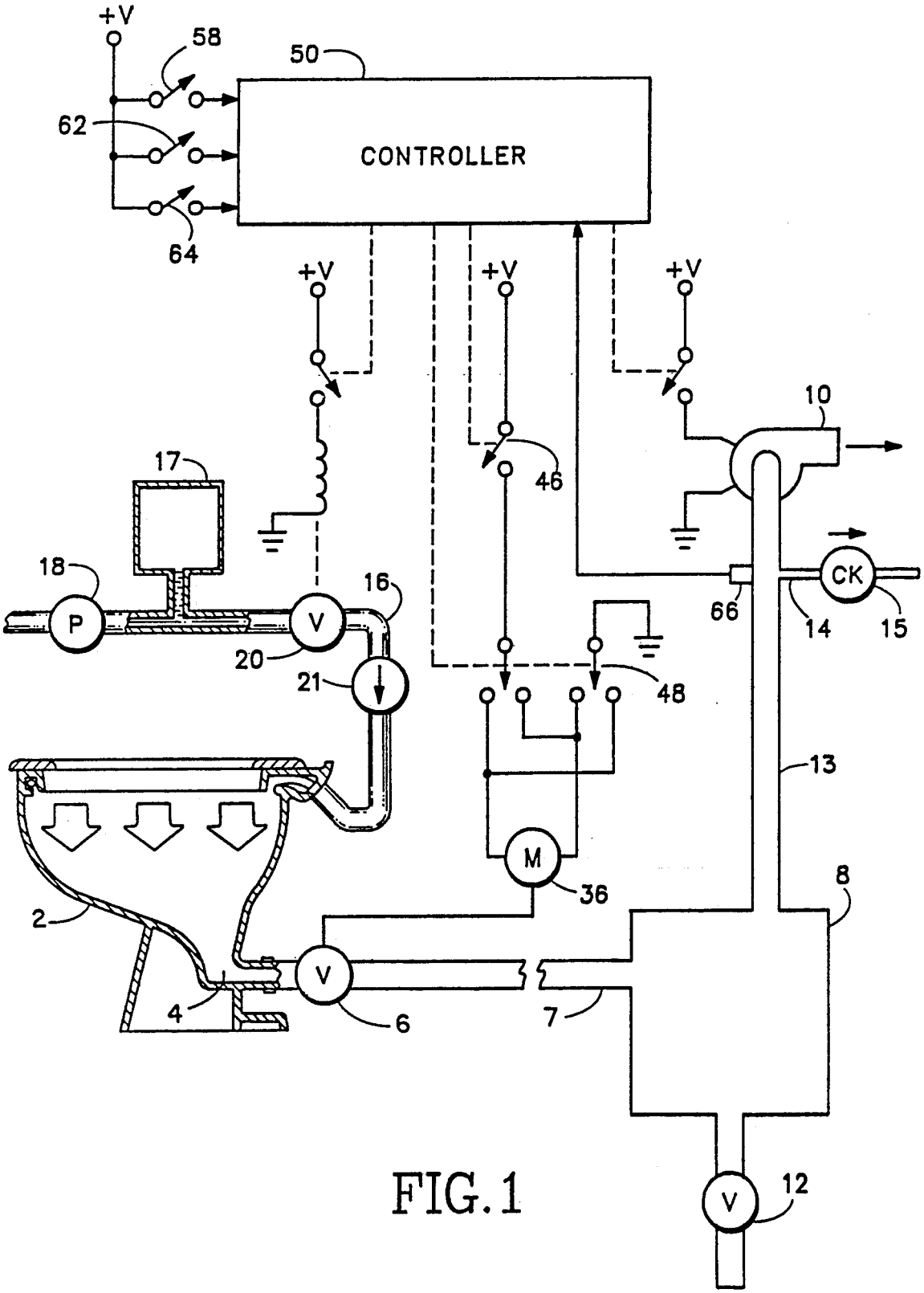
FIG. 1 is a diagrammatic illustration of part of a vacuum toilet system for an aircraft.

The vacuum toilet system that is partially illustrated in FIG. 1 is installed in a toilet compartment of an aircraft and includes a waste-receiving bowl 2 which defines an interior space for receiving waste material and has an outlet opening 4. The outlet opening is connected to one side of a discharge valve 6. The opposite side of the discharge valve is connected through a sewer pipe 7 to a waste tank 8. The discharge valve 6 controls flow of material from the bowl 2 to the pipe 7 and the waste tank 8. An electrically driven blower 10 has its suction side connected to the tank 8 by way of an exhaust duct 13 and has its pressure side connected to the ambient atmosphere. A duct 14 provides communication between the interior of the tank 8 and the ambient atmosphere, subject to the action of a check valve 15, which ensures that the pressure in the tank cannot exceed the ambient pressure except by a threshold amount required to open the valve 15. The tank is also provided with a valve 12 or similar means for emptying the tank.

A pressure difference must exist between the interior of the bowl 2, which is exposed to the pressure existing in the aircraft cabin, and the interior of the sewer pipe 7 and tank 8 in order for the system illustrated in FIG. 1 to operate. Typically, the cabin pressure in an aircraft is not permitted to fall below the ambient pressure at an altitude of about 7,500 ft. (about 2,290 m). Sufficient pressure difference for operating the system exists between the cabin of the aircraft and the interior of the tank when the aircraft is at an altitude greater than about 16,000 ft. (about 4,880 m).

A rinse water supply pipe 16 opens into the bowl 2 by way of a spray nozzle arrangement adjacent the rim of the bowl 2. The rinse water supply pipe 16 is connected to a source of water under pressure, e.g. a pump 18. The pump 18 maintains a pressure of 20–40 psig, preferably 25–35 psig, in the pipe 16. The actual pressure in the pipe 16 will depend on the volume of the pipe downstream of the pump 18, the configuration of the pipe runs, and the rate at which water is taken from the pipe 16. A remote-controlled, solenoid-operated rinse water valve 20 is connected in the water supply pipe 16, and an air cushion device 17 is connected to the pipe 16 between the pump 18 and the valve 20. The rinse water valve operates in accordance with a predetermined cycle, comprising an opening phase, an open phase and a closing phase. Since the valve 20 is solenoid operated, the opening phase and the closing phase are very brief. A vacuum breaker valve 21 is disposed downstream of the valve 20, to prevent reverse flow in the pipe 16 in the event that the pressure upstream of the valve 21 falls below the pressure in the waste-receiving bowl.

The discharge valve 6 is a motor-operated valve, and may be of the kind described in U.S. Pat. No. 4,713,847. The valve has a motor 36 that is connected to a source of DC voltage by way of two switches 46 and 48 (FIG. 1). The switch 46 is an on-off switch and the switch 48 is a double pole, double throw switch. If the switch 46 is in its conductive condition, then in one position of the switch 48 (the valve-opening position), the motor 36 is driven in the direction to open the valve 6 while in the other position of the switch 48 (the valve-closing position) the motor is driven in the direction to close the valve 6. If the switch 46 is in its non-conductive condition, the motor 36 is isolated from the voltage source and therefore is not driven. The operating cycle of the valve 6 therefore has three distinct phases: a valve opening phase, during which the valve is being opened; an open phase, during which the valve is fully open; and a valve closing phase, during which the valve is being closed.

The states of the blower 10, the valve 20 and the motor 36 are determined by the condition of a controller 50. The controller has five inputs, four of which are provided respectively by a user-operated flush control switch 58, two limit switches 62 and 64, and a pressure sensor 66, and also has five outputs. Two of the outputs control switches that are connected to the blower 10 and the rinse water valve 20 for establishing the respective states thereof, two outputs control the switches 46 and 48 for establishing the state of the motor 36. The nature and purpose of the fifth input and fifth output of the controller are not directly pertinent to the present invention, but are described in U.S. Pat. No. 4,713,847.

The two limit switches 62 and 64 are positioned so that they are engaged when the valve 6 arrives at its open condition and its closed condition respectively. The pressure sensor 66 is mounted in the exhaust duct 13 leading from the tank 8 to the blower 10, and measures the pressure difference existing between the aircraft cabin and the tank 8. In order to carry out a flushing operation, the pressure in the tank 8 must be considerably lower than that in the aircraft cabin. Each time flushing is initiated, the pressure sensor checks whether there is sufficient vacuum in the tank 8. If the pressure difference between the tank 8 and the aircraft cabin is more than about 250 mbar, the flushing cycle commences substantially immediately, whereas if the pressure difference is less than about 250 mbar the blower starts and the flushing cycle commences after a short time delay, to allow the blower to reduce the pressure in the tank to a sufficient extent for there to be a high degree of reliability that the normal flushing cycle will be completed.

Instead of using the pressure sensor 66 to measure the pressure difference existing between the aircraft cabin and the tank, an altitude switch may be used to determine whether the blower 10 is operated: at altitudes below about 16,000 ft., the blower is turned on when flushing is initiated.

Figures 2, 3:
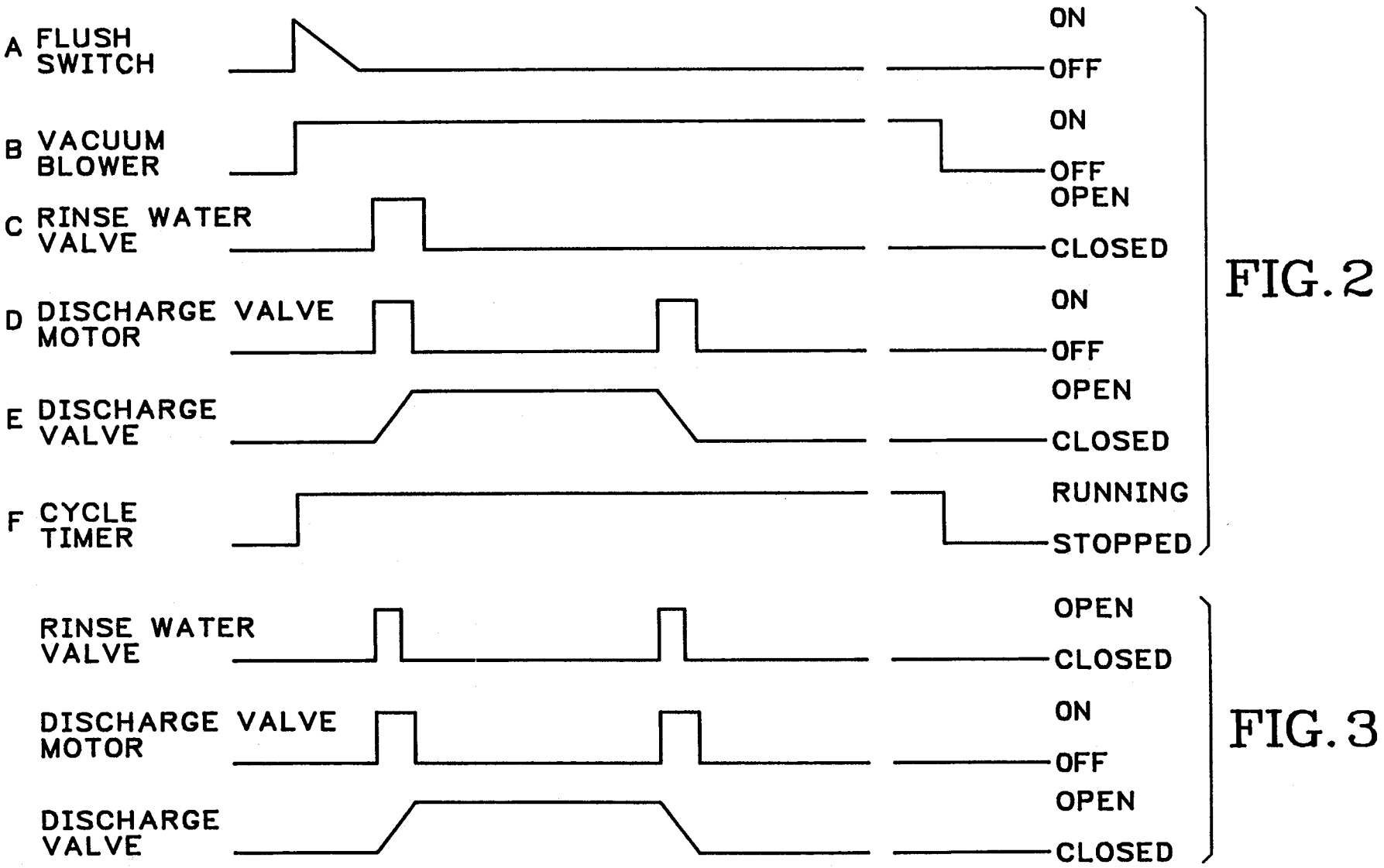
FIG. 2 is a timing diagram for illustrating operation of the FIG. 1 system.
FIG. 3 is a timing diagram for illustrating operation of a modification of the FIG. 1 system.

FIG. 2 indicates the sequence of operation of the FIG. 1 system. In the quiescent state of the vacuum toilet system, the blower 10 is not running, the valves 6 and 20 are closed, the switch 46 is in its non-conductive condition and the switch 48 is in the valve-opening position. In this state, a user of the system may initiate a flushing operation by momentarily closing the switch 58. The controller 50 responds to closing of the switch 58 by starting a cycle timer, and on starting of the cycle timer the blower 10 is activated (unless the sensor 66 is providing a blower-disable signal). See FIG. 2, waveforms A, B and F. The cycle timer also inhibits the input provided by the switch 58 so that a second actuation of the switch 58 during a limited inhibit time will have no effect on the controller.

About 1 s after starting the cycle timer, the controller 50 provides an output to cause the rinse water valve 20 to open (waveform C). The rinse water valve opens substantially instantaneously, and the controller 50 maintains the valve 20 in its open condition for a predetermined time, e.g. about 0.7 s. This time is sufficient to provide adequate rinse water. The amount of rinse water may be about 0.2 l, which is substantially less than the amount of rinse liquid required to carry out a flushing operation with a conventional recirculating toilet system. Simultaneously with initiating supply of current to the rinse water valve 20, the controller provides a signal to place the switch 46 in its conductive condition. Since the switch 48 is in the valve-opening position, the motor 36 opens the valve. Waveforms D and E. The limit switch 62 is engaged when the valve is fully open, and upon detecting closing of the limit switch 62 the controller 50 places the switch 46 in its non-conductive condition and thereby interrupts supply of current to the motor 36, and also transfers the switch 48 to the valve-closing position. The valve opening phase lasts approximately 0.6 s. When the discharge valve 6 is in its fully open condition, the vacuum established in the tank 8 by the blower 10 (or by external conditions) is communicated to the waste-receiving bowl by way of the sewer pipe and the valve 6, and waste material and rinse water in the bowl are rapidly drawn from the bowl, past the valve 6. After about 3 s, the controller places the switch 46 in its conductive condition, and accordingly the motor 36 closes the valve 6. The valve closing phase lasts approximately 0.6 s. The limit switch 64 is engaged when the discharge valve attains its closed condition, and the controller responds to closing of the switch 64 by placing the switch 46 in its non-conductive condition so as to stop the motor, and transferring the switch 48 to its valve-opening position. The timer continues to run until about 15 s after actuation of the switch 58, and then stops, and the inhibit on the input provided by the switch 58 is removed. At this point, the blower drive signal also is removed and the blower stops, (assuming that the blower 10 was not disabled by the controller in response to a blower-disable signal). A further flushing operation can then be started by actuating the switch 58.

It has been found that by introducing rinse water into the bowl during the opening phase of the discharge valve operation, the noise level is reduced substantially. In one experiment, the noise level was reduced by 4 dB.

The noise level in the toilet compartment depends at least in part on the velocity with which air flows through the outlet opening 4 into the sewer pipe. When the discharge valve is closed, the air velocity is zero. During the opening phase, the air flow velocity initially increases as the valve is being opened and then decreases, as the pressure immediately downstream of the valve increases, until the valve is fully open. During the closing phase, the flow velocity initially increases and then decreases as the valve reaches its closed condition. Accordingly, during the valve operating cycle, there are two peaks in the noise level, one during the valve opening phase and the other during the valve closing phase.

An alternative operating sequence, as shown in FIG. 3, can be used to open the rinse water valve twice during the operating cycle of the discharge valve and reduce the noise level during both the valve opening phase and the valve closing phase.

As shown in FIG. 3, the rinse water valve is opened during the valve opening phase of the operating cycle of the discharge valve, and is opened again during the valve closing phase. By opening the rinse water valve on two occasions, the noise level is reduced both during the valve opening phase and during the valve closing phase.

Each time that the rinse water valve is opened in the FIG. 3 operating sequence, it remains open for about half the period for which it is opened in the FIG. 2 sequence, and therefore the amount of rinse water that is employed is the same for both sequences. Since the period for which the rinse water valve is opened in the case of the FIG. 2 sequence is only slightly longer than the duration of the valve opening or closing phase of the discharge valve in the case of the FIG. 3 sequence, the period for which the rinse water valve is opened on each occasion is shorter than the duration of the valve opening phase or the valve closing phase.

It will be appreciated that the invention is not restricted to the particular embodiment that has been described, and that variations may be made therein without departing from the scope of the invention as defined in the appended claims and equivalents thereof. For example, the invention is not limited to a vacuum toilet system for transport vehicles, and in the context of vacuum toilet systems for transport vehicles, the invention is not limited to use with aircraft. The time periods referred to in connection with FIGS. 2 and 3 of the drawings are given by way of example only and not by way of limitation, and in particular the time period for which the discharge valve is in the fully open condition may be considerably shorter than 3 s, in order to reduce the interval in which noise is generated, so long as the pressure difference between the sewer pipe 7 and the interior of the bowl 2 is sufficient to ensure that the waste material will be removed from the bowl. Also, it is not essential that the blower drive signal be removed when the cycle timer stops running: the blower drive signal may be controlled by a separate timer that runs for a shorter or longer period than the cycle timer. It is not essential to the invention that the source of water under pressure be a pump and an air cushion device, as shown in FIG. 1. For example, the pipe 16 upstream of the valve 20 may be connected to a water tank, and the contents of the tank may be kept under pressure by a blower that maintains an air cushion over the water in the tank.

We claim:

1. An improved vacuum toilet system comprising:

a waste-receiving bowl defining an interior space for receiving waste material and having an outlet, a sewer pipe defining an interior space that can be placed at a pressure that is lower than that in the interior space of the waste-receiving bowl.

a discharge valve connected between the outlet of the waste-receiving bowl and the sewer pipe for controlling passage of material between the waste-receiving bowl and the sewer pipe, rinse means for controlling supply of rinse liquid to the waste-receiving bowl, and control means connected to the discharge valve and to the rinse means and responsive to a user stimulus to open and close the discharge valve in accordance with a predetermined operating cycle comprising an opening phase, an open phase and a closing phase, wherein the improvement resides in that, in order to reduce the level of noise generated by induction of air into the sewer pipe during the operating cycle of the discharge valve while maintaining a low level of water consumption, the control means control the rinse means in such manner that rinse liquid is supplied during the opening phase of the operating cycle of the discharge valve but substantially no rinse liquid is supplied while the discharge valve is closed or during the open phase of the operating cycle of the discharge valve.

2. A vacuum toilet system according to claim 1, wherein the rinse means comprise a rinse liquid valve for connection to a source of rinse liquid under pressure.

3. A vacuum toilet system according to claim 2, wherein the control means operate the rinse liquid valve in such manner that the rinse liquid valve is open during the opening phase of the operating cycle of the discharge valve but is substantially closed during a substantial part of the closing phase of the operating cycle of the discharge valve.

4. A vacuum toilet system according to claim 3, wherein the control means operate the rinse liquid valve in accordance with a predetermined cycle comprising an opening phase, an open phase and a closing phase, and the beginning of the opening phase of the operating cycle of the rinse liquid valve substantially coincides with the beginning of the opening phase of the operating cycle of the discharge valve.

5. A vacuum toilet system according to claim 3, wherein the control means are operative to maintain the rinse liquid valve open for an interval that is slightly longer than the opening phase of the operating cycle of the discharge valve.

6. A vacuum toilet system according to claim 5, wherein the control means are operative to maintain the rinse liquid valve open beyond the beginning of the open phase of the operating cycle of the discharge valve for a time that is much shorter than the duration of the open phase.

7. A vacuum toilet system according to claim 1, wherein the rinse liquid valve is an electrically operated valve and the discharge valve is an electrically operated valve.

8. An improved vacuum toilet system comprising:

a waste-receiving bowl defining an interior space for receiving waste material and having an outlet, a sewer pipe defining an interior space that can be placed at a pressure that is lower than that in the interior space of the waste-receiving bowl, a discharge valve connected between the outlet of the waste-receiving bowl and the sewer pipe for controlling passage of material between the waste-receiving bowl and the sewer pipe, a rinse liquid valve for controlling supply of rinse liquid to the waste-receiving bowl from a source of rinse liquid under pressure, and control means connected to the discharge valve and to the rinse liquid valve and responsive to a user stimulus to open and close the discharge valve in accordance with a predetermined operating cycle comprising an opening phase, an open phase and a closing phase, wherein the improvement resides in that, in order to reduce the level of noise generated by induction of air into the sewer pipe during the operating cycle of the discharge valve while maintaining a low level of water consumption, the control means control the rinse liquid valve in such manner that rinse liquid is supplied during both the opening phase and the closing phase of the operating cycle of the discharge valve but substantially no rinse liquid is supplied while the discharge valve is closed or during the open phase of the operating cycle of the discharge valve.

9. A vacuum toilet system according to claim 8, wherein the control means operate the rinse liquid valve in accordance with a predetermined cycle comprising an opening phase, an open phase and a closing phase, and the beginning of the opening phase of the operating cycle of the rinse liquid valve on the first occasion substantially coincides with the beginning of the opening phase of the operating cycle of the discharge valve and the beginning of the opening phase of the operating cycle of the rinse liquid valve on the second occasion substantially coincides with the beginning of the closing phase of the operating cycle of the discharge valve.

10. A vacuum toilet system according to claim 9, wherein the control means are operative to maintain the rinse liquid valve open on the first and second occasions each for an interval that is shorter than the opening phase or the closing phase of the operating cycle of the discharge valve.

11. A method of operating a vacuum sewage system that comprises a waste-receiving bowl defining an interior space for receiving waste material and having an outlet, a sewer pipe defining an interior space that can be placed at a pressure that is lower than that in the interior space of the waste-receiving bowl, a discharge valve connected between the outlet of the waste-receiving bowl and the sewer pipe for controlled passage of material between the waste-receiving bowl and the sewer pipe, and rinse means for controlling supply of rinse liquid to the waste-receiving bowl, the method comprising:

operating the discharge valve in accordance with a predetermined operating cycle in response to a user stimulus, the operating cycle comprising an opening phase, an open phase and a closing phase, and operating the rinse means in such a manner that rinse liquid is supplied during the opening phase of the operating cycle of the discharge valve but substantially no rinse liquid is supplied while the discharge valve is closed or during the open phase of the operating cycle of the discharge valve, whereby the level of noise generated by induction of air into the sewer pipe is reduced while the consumption of water is maintained at a low level.

12. A method according to claim 11, comprising operating the rinse means in such manner that rinse liquid is supplied during the opening phase of the operating cycle of the discharge valve but substantially no rinse liquid is supplied during the closing phase of the operating cycle of the discharge valve.

13. A method according to claim 12, wherein the rinse means comprise a rinse liquid valve and the step of operating the rinse means comprises opening and closing the rinse liquid valve.

14. A method according to claim 13, wherein operation of the rinse liquid valve takes place in accordance with a predetermined cycle comprising an opening phase, an open phase and a closing phase, and the beginning of the opening phase of the operating cycle of the rinse liquid valve substantially coincides with the beginning of the opening phase of the operating cycle of the discharge valve.

15. A method according to claim 8, wherein the rinse means comprise a rinse liquid valve and the step of operating the rinse means comprises opening and closing the rinse liquid valve.

16. A method according to claim 7, wherein operation of the rinse liquid valve takes place in accordance with a predetermined cycle comprising an opening phase, an open phase and a closing phase, and the beginning of the opening phase of the operating cycle of the rinse liquid valve on the first occasion substantially coincides with the beginning of the opening phase of the operating cycle of the discharge valve and the beginning of the opening phase of the operating cycle of the rinse liquid valve on the second occasion substantially coincides with the beginning of the closing phase of the operating cycle of the discharge valve.

17. An improved method of operating a vacuum sewage system that comprise a waste-receiving bowl defining an interior space for receiving waste material and having an outlet, a sewer pipe defining an interior space that can be placed at a pressure that is lower than that in the interior space of the waste-receiving bowl, an electrically operated discharge valve connected between the outlet of the waste-receiving bowl and the sewer pipe for controlling passage of material between the waste-receiving bowl and the sewer pipe, and an electrically operated rinse liquid valve for controlling supply of rinse liquid to the waste-receiving bowl, the method comprising:

operating the discharge valve in accordance with a predetermined operating cycle in response to a user stimulus, the operating cycle comprising an opening phase, an open phase and closing phase, and operating the rinse liquid valve in response to said user stimulus to supply rinse liquid to the waste-receiving bowl during a predetermined interval relative to the user stimulus, wherein the improvement resides in that, in order to achieve a low level of noise due to induction of air into the sewer pipe during the operating cycle of the discharge valve while maintaining a low level of water consumption, the method comprises energizing the rinse liquid valve during the opening phase of the operating cycle of the discharge valve and maintaining the rinse liquid valve in a de-energized state while the discharge valve is closed and during the open phase of the operating cycle of the discharge valve.

18. A method of operating a vacuum sewage system that comprises a waste-receiving bowl defining an interior space for receiving waste material and having an outlet, a sewer pipe defining an interior space that can be placed at a pressure that is lower than that in the interior space of the waste-receiving bowl, a discharge valve connected between the outlet of the waste-receiving bowl and the sewer pipe for controlling passage of material between the waste-receiving bowl and the sewer pipe, and rinse means for controlling supply of rinse liquid to the waste-receiving bowl, the method comprising:

operating the discharge valve in accordance with a predetermined operating cycle in response to a user stimulus, the operating cycle comprising an opening phase, an open phase and a closing phase, and operating the rinse means in such a manner that rinse liquid is supplied during both the opening phase and the closing phase of the operating cycle of the discharge valve but substantially no rinse liquid is supplied while the discharge valve is closed or during the open phase of the operating cycle of the discharge valve, whereby the level of noise generated by induction of air into the sewer pipe is reduced while the consumption of water is maintained at a low level.

* * * * *